United States Patent [19]

Kopatz et al.

[11] Patent Number: 4,670,047

[45] Date of Patent: Jun. 2, 1987

[54] PROCESS FOR PRODUCING FINELY DIVIDED SPHERICAL METAL POWDERS

[75] Inventors: Nelson E. Kopatz; Lori S. Pruyne, both of Sayre; Howard H. Shaw, Monroeton, all of Pa.

[73] Assignee: GTE Products Corporation, Stamford, Conn.

[21] Appl. No.: 906,370

[22] Filed: Sep. 12, 1986

[51] Int. Cl.[4] ..... B22F 9/00

[52] U.S. Cl. ..... 75/0.5 B; 75/0.5 BB; 75/0.5 BC; 75/0.5 BA; 75/10.19; 264/15

[58] Field of Search ..... 75/0.5 B, 0.5 BB, 0.5 BC, 75/10.19, 10.20, 0.5 R; 264/15

[56] References Cited

U.S. PATENT DOCUMENTS

| | | | |
|---|---|---|---|
| 3,852,061 | 12/1974 | Wulff | 75/10.2 |
| 3,909,241 | 9/1975 | Cheney et al. | 75/0.5 BB |
| 3,974,245 | 8/1976 | Cheney et al. | 75/0.5 B |
| 4,264,354 | 4/1981 | Cheetham | 75/251 |
| 4,502,885 | 3/1985 | Cheney | 75/0.5 B |
| 4,568,384 | 2/1986 | Maher | 75/0.5 B |
| 4,592,781 | 6/1986 | Cheney et al. | 75/0.5 B |

OTHER PUBLICATIONS

Merriman, A. D.; *A Dictionary of Metallurgy;* Macdonald & Evans; London, 1958; p. 257.

*Primary Examiner*—Wayland Stallard
*Attorney, Agent, or Firm*—Donald R. Castle

[57] ABSTRACT

A process is disclosed for producing finely divided spherical metal powders. The process comprises forming a coating of a surface active agent which can be of the nonionic or anionic type on the surfaces of the particles of a metal powder, feeding the coated particles and a carrier gas into a high temperature zone and maintaining the particles in the zone for a sufficient time to melt at least about 50% by weight of the particles and to form droplets therefrom, and cooling the droplets to form metal particles having essentially a spherical shape with the majority of the particles having a size less than about 50 micrometers.

7 Claims, No Drawings

PROCESS FOR PRODUCING FINELY DIVIDED SPHERICAL METAL POWDERS

FIELD OF THE INVENTION

This invention relates to the preparation of metal alloy powders. More particularly it relates to the production of such powders having substantially spherical particles.

BACKGROUND OF THE INVENTION

This invention relates to spherical powder particles and to the process for producing the particles which involves mechanically reducing the size of a starting material followed by high temperature processing to produce fine spherical particles. More particularly, the high temperature process is a plasma process.

U.S. Pat. No. 3,909,241 to Cheney et al relates to free flowing powders which are produced by feeding agglomerates through a high temperature plasma reactor to cause at least partial melting of the particles and collecting the particles in a cooling chamber containing a protective gaseous atmosphere where the particles are solidified.

The only commercial process for producing such metal powder particles is by gas or water atomization. Only a small percentage of the powder produced by atomization is less than about 20 micrometers in size. When further size reduction occurs by conventional means the powders tend to agglomerate. Therefore yields are low and powder costs are high as a result.

SUMMARY OF THE INVENTION

A process which yields fine spherical metal powder particles from irregular shaped particles in relatively high yields would be an advancement in the art.

In accordance with one aspect of this invention, there is provided a process comprising (a) forming a coating of a surface active agent which can be of the nonionic or anionic type, on the surfaces of the particles of a metal powder, (b) feeding the particles into a high temperature zone having a temperature sufficiently high to form molten droplets of at least about 50% by weight of the metallic powder particles, and (c) cooling the molten droplets for form metal particles having essentially a spherical shape with the majority of the essentially spherical particles having a particle size of less than about 50 micrometers.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

It has been found that metal powders fed to a high temperature reactor such as a plasma tend to agglomerate and cause the average particle size of the plasma melted material to be larger than the average particle size prior to melting. The process of this invention prevents this agglomeration.

Metal powders as used in this invention can mean metal powders or metal alloy powders.

The size of the starting material can be first mechanically reduced to produce a finer powder material. The starting material can be of any size of diameter initially.

For most uses contemplated, the size of the major portion of the material is reduced to less than about 20 micrometers.

The mechanical size reduction can be accomplished by techniques such as by crushing, jet milling, attritor, rotary, or vibratory milling with attritor ball milling being the preferred technique for materials having a starting size of less than about 1000 micrometers in size.

A preferred attritor mill is manufactured by Union Process under the trade name of "The Szegvari Attritor." This mill is a stirred media ball mill. It is comprised of a water jacketed stationary cylindrical tank filled with small ball type milling media and a stirrer which consists of a vertical shaft with horizontal bars. As the stirrer rotates, balls impact and shear against one another. If metal powder is introduced into the mill, energy is transferred through impact and shear from the media to the powder particles, causing cold work and fracture fragmentation of the powder particles. This leads to particle size reduction. The milling process may be either wet or dry, with wet milling being the preferred technique. During the milling operation the powder can be sampled and the particle size measured. When the desired particle size is attained, the milling operation is considered to be complete.

The particles of the metal powder are coated with a surface active agent (surfactant) which can be of either the nonionic or the anionic type.

Suitable nonionic surfactants that can be used are the polyoxyethylene, ethoxylated alkylphenols, ethoxylated aliphatic alcohols, carboxylic esters, carboxylic amides, polyoxyethylene fatty acid amides, and polyalkyline oxide block copolymers. One preferred nonionic surfactant is sold by Rohm and Haas Company under the trade name of "Triton X-100."

Suitable anionic surfactants that can be used are carboxylates, polyalkoxycarboxylates, N-acylsarcosinates, sulfonates, alkylbenzenesulfonates, alkylarenesulfonates (short chain), lignosulfonates, naphthalenesulfonates, alpha olefinsulfonates, petroleum sulfonates, sulfonates with ester, amide, or ether linkages, amidosulfonates, sulfates and sulfated products, alcohol sulfates, alcohols (ethoxylated and sulfated), alkylphenols (ethoxylated and sulfated), and sulfated acids, amides, and esters. Preferred of these is a sodium N-acyl-N-alkyltaurate supplied by GAF Corporation under the trade name of Igepon T 77.

Suitable nonionic and anionic surfactants are listed in Vol. 22, Kirk Othmer, Encyclopedia of Chemical Technology, 3rd. Edition.

It is believed that these surfactants act to neutralize or shield against electrostatic charges that may act to agglomerate the metal powder particles together.

It is preferred to form the coating by forming an aqueous solution of the surfactant and wetting the particles with the solution. An aqueous solution having a concentration of the surfactant of from about 0.1% by weight to about 1% by weight is suitable for coating an equal weight amount of metal powder. The metal particles that are coated can then by dried and screened through a 170 mesh screen.

The surfactant coated powders are used to form a high velocity stream of molten metal droplets. Such a stream may be formed by any thermal spraying technique such as electric-arc spraying, combustion spraying, and plasma spraying. Typically, the velocity of the molten droplets is greater than about 250 meters per second. Velocities on the order of 900 meters per second or greater may be achieved under certain conditions which favor these speeds which may include spraying in a vacuum.

In the preferred process of the present invention, a powder is fed through a thermal spray apparatus. Feed powder is entrained in a carrier gas and then fed through a high temperature reactor. The temperature in the reactor is preferably above the melting point of the highest melting component of the metal powder and even more preferably considerably above the melting point of the highest melting component of the material to enable a relatively short residence time in the reaction zone.

The stream of dispersed entrained molten metal droplets may be produced by plasma-jet torch or gun apparatus of conventional nature. Typical plasma jet apparatus is of the DC arc or induction type. In general, a source of metal powder is connected to a source of propellant gas. A means is provided to mix the gas with the powder and propel the gas with entrained powder through a conduit communicating with a nozzle passage of the plasma spray apparatus. In the arc type apparatus, the entrained powder may be fed into a vortex chamber which communicates with and is coaxial with the nozzle passage which is bored centrally through the nozzle. In an arc type plasma apparatus, an electric arc is maintained between an interior wall of the nozzle passage and an electrode present in the passage. The electrode has a diameter smaller than the nozzle passage with which it is coaxial to so that the gas is discharged from the nozzle in the form of a plasma jet. The current source is normally a DC source adapted to deliver very large currents at relatively low voltages. By adjusting the magnitude of the arc power and the rate of gas flow, torch temperatures can range from about 150° C. up to about 15,000° C. The apparatus generally must be adjusted in accordance with the melting point of the powders being sprayed and the gas employed. In general, the electrode may be retracted within the nozzle when lower melting powders are utilized with an inert gas such as nitrogen while the electrode may be more fully extended within the nozzle when higher melting powders are utilized with an inert gas such as argon.

In the induction type plasma spray apparatus, metal powder entrained in an inert gas is passed at a high velocity through a strong magnetic field so as to cause a voltage to be generated in the gas. The current source is adapted to deliver very high currents, on the order of 10,000 amperes, although the voltage may be relatively low such as 10 volts. Such currents are required to generate a very strong direct magnetic field and create a plasma. Such plasma devices may include additional means for aiding in the initiation of a plasma generation, a cooling means for the torch in the form of an annular chamber around the nozzle.

In the plasma process, a gas which is ionized in the torch regains its heat of ionizaion on exiting the nozzle to create a highly intense flame. In general, the flow of gas through the plasma spray apparatus is effected at speeds at least approaching the speed of sound. The typical torch comprises a conduit means having a convergent portion which converges in a downstream direction to a throat. The convergent portion communicates with an adjacent outlet opening so that the discharge of plasma is effected out the outlet opening.

Other types of torches may be used such as an oxy-acetylene type having a high pressure fuel gas flowing through the nozzle. The powder may be introduced into the gas by an aspirating effect. The fuel is ignited at the nozzle outlet to provide a high temperature flame.

The stream of molten particles may be directed into a cooling fluid. The cooling fluid is typically disposed in a chamber which has an inlet to replenish the cooling fluid which is volatilized and heated by the molten particles. The fluid may be provided in liquid form and volatilized to the gaseous state during the rapid solidification process. The outlet is preferably in the form of a pressure relief valve. The vented gas may be pumped to a collection tank and reliquified for reuse.

The choice of the particles cooling fluid depends on the desired results. If large cooling capacity is needed, it may be desirable to provide a cooling fluid having a high thermal capacity. An inert cooling fluid wich is non-flammable and non-reactive may be desirable if contamination of the product is a problem. In other cases, a reactive atmosphere may be desirable to modify the powder. Liquid argon and liquid nitrogen are preferable in certain cases to reduce oxides and protect from unwanted reactions. If hydride formation is desirable, liquid hydrogen may enhance hydride formation. Liquid nitrogen may enhance nitride formation.

Since the melting plasmas are formed from any of the same gases, the melting system and cooling fluid may be selected to be compatible.

The cooling rate depends on the thermal conductivity of the cooling fluid and the molten particles to be cooled, the size of the stream to be cooled, the size of individual droplets, and the temperature difference between the droplets and the cooling fluid. The cooling rate of the droplets is controlled by adjusting the above mentioned variables. The cooling rate can be controlled by adjusting the distance of the plasma from the liquid bath surface. The closer the nozzle to the surface of the bath, the more rapidly the droplets are cooled.

Powder collection is conveniently accomplished by removing the collected powder from the bottom of the collection chamber. The cooling fluid may be evaporated or retained if desired to provided protection against oxidation or unwanted reactions.

The particle size of the spherical powders will be largely dependent upon the size of the individual surfactant coated particles that are fed into the high temperature reactor. In the practice of this invention, sizes are generally below about 30 micrometers. Some densification occurs and the surface area is reduced, thus the apparent particle size is reduced. The preferred form of particle size measurement is by sedigraph. A majority of the particles will be below about 20 micrometers. The desired size will depend upon the use of the alloy. For example, in certain instances such as microcircuitry applications, extremely finely divided materials are desired such as less than about 3 micrometers. Thus, this invention is particularly suited for the production of precious metals such as silver, gold, platinum, and the like. Silver powder can be processed efficiently by this method. In other instances such as in the production of conventional billets via conventional powder metallurgy, larger powder particles such as up to about 50 micrometers are satisfactory and yields are increased but not as much as with the more finely divided materials.

To more fully illustrate this invention, the following nonlimiting example is presented. All parts, portions, and percentages are on a weight basis unless otherwise stated.

EXAMPLE

About 100 parts of deionized water are mixed with about 1 part of a nonionic surfactant sold under the trade name of Triton X-100 by Rohm and Haas Company. The resulting aqueous solution is blended with about 100 parts of finely divided silver having a particle size of from about 5 to about 15 micrometers. After blending for a sufficient time to wet essentially all of the particles, the wetted particles are air dried and then screened through a 170 mesh screen.

The silver powder particles are entrained in argon as a carrier gas. The particles are fed to a METCO 9MB plasma gun at the rate of about 9 pounds per hour. The carrier gas is fed at the rate of about 5 cubic feet per hour. The plasma gas (argon) is fed at the rate of about 60 cubic feet per hour. The torch power is about 30 volts at about 150 amperes. The molten droplets exit into a chamber containing gaseous argon. The mean particle size of the powder produced from the metal powders coated with the surfactant is about 11 microns whereas a substantially identical powder processed without the surfactant has a mean particle size of about 19 microns.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process comprising:

a. forming a coating of a surface active agent selected from the group consisting of nonionic surface active agents and anionic surface active agents on the surfaces of the particles of a metal powder;

b. feeding the resulting coated particles and a carrier gas into a high temperature zone and maintaining said particles in said zone for a sufficient time to melt at least about 50% by weight of said particles, and to form droplets therefrom; and c. cooling said droplets to form metal particles having essentially a spherical shape with a majority of said metal particles having a size of less than about 50 micrometers.

2. A process according to claim 1 wherein said metal is a precious metal.

3. A process according to claim 2 wherein said precious metal is silver.

4. A process according to claim 2 wherein said high temperature zone is created by a plasma torch.

5. A process according to claim 1 wherein said carrier gas is an inert gas.

6. A process according to claim 1 wherein essentially all of said metal particles are melted.

7. A process according to claim 1 wherein at least about 50% by weight of said particles have a size less than about 50 micrometers.

* * * * *